US005272959A

United States Patent [19]

Lonnemo

[11] Patent Number: 5,272,959

[45] Date of Patent: Dec. 28, 1993

[54] POWER TRANSMISSION

[75] Inventor: Kurt R. Lonnemo, Searcy, Ark.

[73] Assignee: Vickers, Incorporated, Troy, Mich.

[21] Appl. No.: 938,491

[22] Filed: Aug. 31, 1992

Related U.S. Application Data

[63] Continuation of Ser. No. 703,451, May 21, 1991, abandoned.

[51] Int. Cl.[5] ..... F15B 11/08

[52] U.S. Cl. ..... 91/461; 137/596.15

[58] Field of Search ..... 91/433, 461; 137/596.14, 596.15

[56] References Cited

U.S. PATENT DOCUMENTS 3,859,791 1/1975 Allen et al. ..... 91/433

4,407,122 10/1983 Nanda ..... 91/461

FOREIGN PATENT DOCUMENTS 9100432 1/1991 PCT Int'l Appl. .

*Primary Examiner*—Edward K. Look

*Assistant Examiner*—F. Daniel Lopez

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump for supplying fluid to said actuator, a directional valve comprising pilot operated meter-in valves to which the fluid from the pump is supplied through first lines for controlling the direction of movement of the actuator, and a pilot operated meter-out valve associated with each opening of the actuator for controlling the flow out of said actuator. The pressure of fluid being supplied to the actuator by the meter-in valve is sensed and supplied to a line extending from the output of the meter-in valve. A valve is provided in this line to provide a force selectively on the meter-in valve opposing the movement of the meter-in valve by the pilot pressure. The valve may comprise either a modulating valve or a shut-off valve.

3 Claims, 2 Drawing Sheets

POWER TRANSMISSION

This is a continuation of copending application Ser. No. 07/703,451 filed on May 21, 1991 now abandoned.

This invention relates to power transmissions and particularly to hydraulic circuits for actuators such as are found on earth moving equipment including excavators.

BACKGROUND AND SUMMARY OF THE INVENTION

This invention relates to hydraulic systems for controlling a plurality of actuators such as hydraulic cylinders which are found, for example, in earth moving equipment such as excavators and cranes. In such a system, it is conventional to provide a pilot operated control valve for each actuator which is controlled by a controller through a pilot hydraulic circuit. The control valve functions to supply hydraulic fluid to the actuator to control the speed and direction of operation of the actuator. In addition, the control valve for each actuator controls the flow of hydraulic fluid out of the actuator. It is also common to provide counterbalance valves or fixed restrictions to control overrunning loads.

In U.S. Pat. No. 4,201,052 and U.S. Pat. No. 4,480,527, having a common assignee with the present application, there is disclosed and claimed a hydraulic system for accurately controlling the position and speed of operation of the actuators; which system is simple and easy to make and maintain; which system is unaffected by change of load pressure of various portions of the system or other actuators served by the same source; which system may not use flow from the pressure source in the case of overrunning loads on the actuators; wherein the control valves may be mounted adjacent the actuator for preventing loss of control of the load in case of malfunction in the hydraulic lines to the actuator; wherein the valves which control flow out of the actuator function to control the velocity in the case of energy generating loads; wherein the valve that controls flow into the actuator controls the velocity in the case of energy absorbing loads; wherein the valve system for each actuator can be mounted on its respective actuator and incorporates means for preventing uncontrolled lowering of the load in case of pressure failure due to breaking of the lines to the actuator mounted valve system; wherein the timing of operation of the valve controlling flow into the actuator and out of the actuator can be designed to accommodate the specific nature of the particular load. In certain high inertial loads such as swing drives on an excavator which utilize rotary actuators, smooth stopping and starting of the load and accurate positioning of the load are very essential.

In U.S. Pat. No. 4,407,122, there is disclosed a hydraulic system of the type shown in the aforementioned U.S. Pat. Nos. 4,201,052 and 4,480,527 modified to provide for smooth stopping and starting and accurate positioning of the load under inertial loads. The supply pressure out of the meter-in valve means is sensed and a force is applied to the meter-in valve means opposing the pilot pressure which tends to open the meter-in valve means.

Such a pressure mode system functions satisfactorily under pressure control for various functions of machines such as swinging or digging. However, under certain conditions, it is desirable to have the same machine function in either a true velocity or flow control mode. For example, if an earth moving machine or device is a front-end loader with a bucket to cut sod, where the system has pressure control, any sudden decrease of the load would cause the system to respond immediately and increase the flow to the hydraulic actuator or actuators and make the sod cutting operation precarious.

Accordingly, among the objectives of the invention are to provide a hydraulic system which can be operated selectively in a flow or velocity control mode or a pressure control mode; which can be readily applicable to a hydraulic system having velocity control; which in one form modulates force applied to the meter-in valve means opposing pilot pressure to the meter-in valve means; and which in another form can cause the hydraulic system to function either in a flow or velocity control mode or a pressure control mode.

In accordance with the invention, a hydraulic control system comprising a hydraulic actuator having opposed openings adapted to alternately function as inlets and outlets for moving the element of the actuator in opposite directions, a pump for supplying fluid to said actuator, a directional valve comprising pilot operated meter-in valves to which the fluid from the pump is supplied through first lines for controlling the direction of movement of the actuator, and a pilot operated meter-out valve associated with each opening of the actuator for controlling the flow out of said actuator. The pressure of fluid being supplied to the actuator by the meter-in valve is sensed and supplied to a line extending from the output of the meter-in valve. A valve is provided in this line to provide a force selectively on the meter-in valve opposing the movement of the meter-in valve by the pilot pressure. The valve may comprise either a modulating valve or a shut-off valve.

DESCRIPTION

Figure 1:
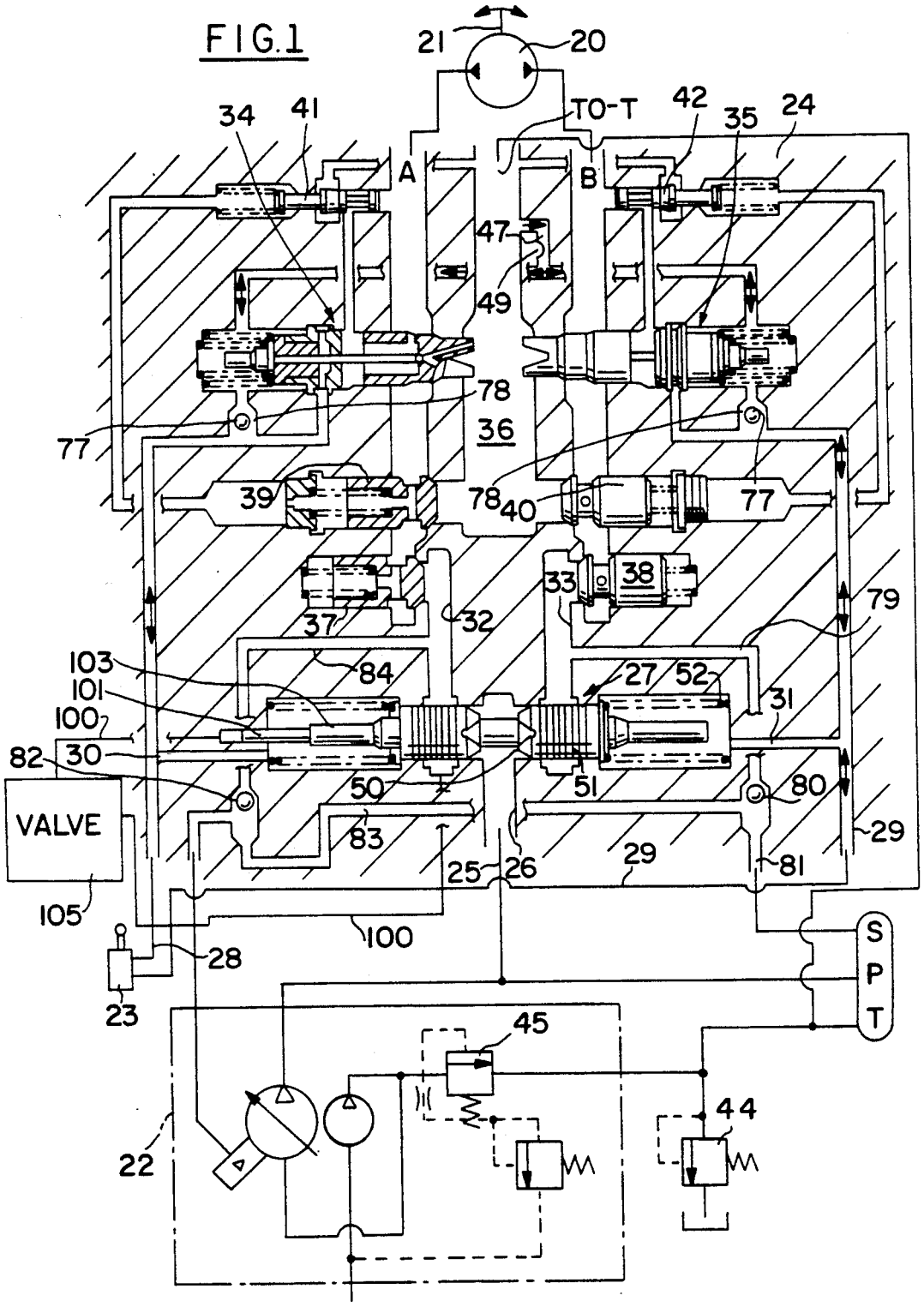
FIG. 1 is a hydraulic schematic of a hydraulic system embodying the invention.

Referring to FIG. 1, the hydraulic system embodying the invention comprises an actuator 20, herein shown as a rotary hydraulic cylinder, having an output shaft 21 that is moved in opposite directions by hydraulic fluid supplied from a variable displacement pump system 22 which has load sensing control in accordance with conventional construction. The hydraulic system further includes a manually operated controller 23 that directs a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller 23, through lines 28, 29 and lines 30, 31 to the opposed ends thereof, as presently described. Depending upon the direction of movement of the valve, hydraulic fluid passes through lines 32, 33 to one or the other end of the actuator 20.

The hydraulic system 24 further includes a meter-out valve 34, 35 associated with each end of the actuator in lines 32, 33 for controlling the flow of fluid from the end of the actuator to which hydraulic fluid is not flowing from the pump to a tank passage 36, as presently described.

The hydraulic system 24 further includes spring loaded poppet valves 37, 38 in the lines 32, 33 and spring loaded anticavitation valves 39, 40 which are adapted to open the lines 32, 33 to the tank passage 36. In addition, spring loaded poppet valves, are associated with each meter-out valve 34, 35 acting as pilot operated relief valves. A bleed line 47 having an orifice 49 extends from passage 36 to meter-out valves 34, 35 and to the pilot control lines 28, 29 through check valves 77 in branch lines 78. The spring ends of meter-out valves 34, 35 are connected to lines 36.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Meter-in valve 27 comprises a bore in which a spool is positioned and the absence of pilot pressure maintained in a neutral position by springs. The spool normally blocks the flow from the pressure passage 26 to the passages 32, 33. When pilot pressure is applied to either passage 30 or 31, the meter-in spool is moved in the direction of the pressure until a force balance exists among the pilot pressure, the spring load and the flow forces. The direction of movement determines which of the passages 32, 33 is provided with fluid under pressure from passage 26.

When pilot pressure is applied to either line 28 or 29, leading to meter-out valves 34 or 35, the valve is actuated to throttle flow from the associated end of actuator 20 to tank passage 36.

It can thus be seen that the same pilot pressure which functions to determine the direction of opening of the meter-in valve also functions to determine and control the opening of the appropriate meter-out valve so that the fluid in the actuator can return to the tank line.

In the case of an energy absorbing load, when the controller is moved to operate the actuator 20 in a predetermined direction, pilot pressure applied through line 28 and passage 30 moves the spool of the meter-in valve to the right causing hydraulic fluid under pressure to flow through passage 33 opening valve 38 and continuing to the inlet B of actuator 20. This same pilot pressure is applied to the meter-out valve 34 permitting the flow of fluid out of the end of the actuator 20 to the return or tank passage 36.

When the controller is moved to operate the actuator, for example, for an overrunning or lowering a load, the controller is moved so that pilot pressure is applied to the line 28. The meter-out valve 34 opens before the meter-in valve 27 under the influence of pilot pressure. The load on the actuator forces hydraulic fluid through the opening A of the actuator past the meter-out valve 34 to the return or tank passage 36. At the same time, the valve 40 is opened permitting return of some of the fluid to the other end of the actuator through opening B thereby avoiding cavitation. Thus, the fluid is supplied to the other end of the actuator without opening the meter-in valve 27 and without utilizing fluid from the pump.

To achieve a float position, the controller is bypassed and pilot pressure is applied to both pilot pressure lines 28, 29. This is achieved, for example, by a circuit, not shown, which will apply the fluid from a pilot pump directly to lines 28, 29 causing both meter-out valves 34 and 35 to open and thereby permit both ends of the actuator to be connected to tank pressure. In this situation, the meter-out valves function in a manner permitting fluid to flow back and forth between opposed ends of the cylinder.

By varying the spring forces and the areas on the meter-in valve 27 and the meter-out valves 34, 35, the timing between these valves can be controlled. Thus, for example, if the timing is adjusted so that the meter-out valve leads the meter-in valve, the meter-in valve will control flow and speed in the case where the actuator is being driven. In such an arrangement with an overhauling load, the load-generated pressure will result in the meter-out valve controlling flow and speed. In such a situation, the anti-cavitation check valves 39, 40 will permit fluid to flow to the supply side of the actuator so that no pump flow is needed to fill the actuator in an overhauling load mode or condition.

A check valve 77 is provided in a branch of each pilot line 28, 29 adjacent each meter-out valve 34, 35. The valves 77 allow fluid to bleed from the high tank pressure in passage 36, which fluid is relatively warm, and to circulate through pilot lines 28, 29 back to the controller and the fluid reservoir when no pilot pressure is applied to the pilot lines 28, 29. When pilot pressure is applied to a pilot line, the respective check valve 77 closes isolating the pilot pressure from the tank pressure.

Provision is made for sensing the maximum load pressure in one of a multiple of valve systems 24 controlling a plurality of actuators and applying that higher pressure to the load sensitive variable displacement pump 22. Each valve system 24 includes a line 81 extending to a shuttle valve 80 that receives load pressure from an adjacent actuator through line 79. Shuttle valve 80 senses which of the pressures is greater and shifts to apply the higher pressure to pump 22. A line 84 extends from passage 32 to shuttle valve 82. Shuttle valve 82 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The meter-in valve 27 comprises a bore 50 in which a spool 51 is positioned and in the absence of pilot pressure maintained in a neutral position by springs 52. The spool 51 normally blocks the flow from the pressure passage 26 to the passages 32, 33. When pilot pressure is applied to either passage 30 or 31, the meter-in spool 51 is moved in the direction of the pressure until a force balance exists among the pilot pressure, the spring load and the flow forces. The direction of movement determines which of the passages 32, 33 is provided with fluid under pressure from passage 26.

The above described circuit is shown and described in the aforementioned U.S. Pat. Nos. 4,201,052 and 4,480,527. The single meter-in valve 27 may be replaced by two meter-in valves as described in the aforementioned U.S. Pat. No. 4,480,527.

The details of the preferred construction of the elements of the hydraulic circuit are more specifically described in the aforementioned U.S. Pat. Nos. 4,201,052 and 4,480,527 which are incorporated herein by reference.

In a manner similar to U.S. Pat. No. 4,407,122, incorporated herein by reference, the system of the present invention includes a load piston or force rod 101. The load or outlet pressure is also applied through a separate line 100 to the end of the load piston 101 so that outlet pressure may act on an area equivalent to the area of the piston 101 opposing the force tending to open the spool.

For example, if pilot pressure is applied tending to shift the meter-in spool to the left in order to supply pressure to a port of rotary actuator, outlet pressure is applied on the area of force rod or piston 101 at the opposite end of the meter-in valve opposing the force tending to open the spool.

Without the load piston 101, the flow to the actuator is in a flow control mode independent of the load pressure. Thus, a step input of flow to a stationary load could result in high pressure peaks and resulting high acceleration. As the load starts to move, pressure could drop and result in low acceleration. Thus, the load could start and stop giving jerky motion. By introducing a feedback piston, the load pressure now reduces the opening of the meter-in spool and thus reducing the flow to the load during periods of high acceleration and with reduced load pressure condition there would be less feedback pressure and thus larger opening of the meter-in spool whereby more flow is introduced during period of low acceleration thus maintaining a more smoother acceleration.

In accordance with the present invention, the hydraulic circuit includes a control system having the load pressure feedback line 100 to the force rod 101 preferably externally of the housing 24 between the line 32 supplying hydraulic fluid to the opening of a hydraulic actuator from the directional valve 27. A control valve 105 is provided in the line 100. The line 100 extends to the force rod 101 that is reciprocably mounted in the housing of the valve system and engages the end 103 of the spool of the meter-in valve 27. A similar construction may be provided on the other end of the meter-in valve 27. The control valve 105 may comprise a modulating valve or an on-off valve, as presently described.

With the on-off valve open, the system functions in a pressure control mode to produce a force opposing the movement of the directional valve resulting in a smooth and accurate control of the actuator in moving inertial loads.

Figure 2:
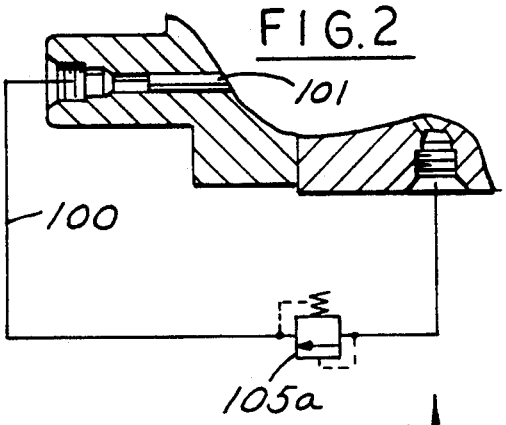
FIG. 2 is a schematic of one form of a system.
Figure 3:
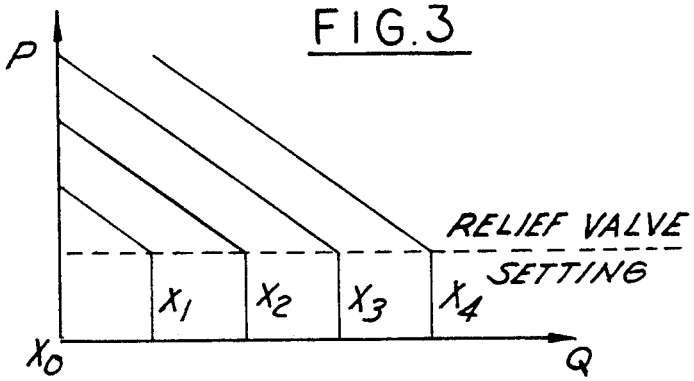
FIG. 3 are curves of pressure versus flow for the system in FIG. 2.

The valve 105 in line 100 may comprise a modulating valve **105*a* as shown in FIG. 2 in the form of an internally vented relief valve. With such a valve 105*a*, the system can be operated to produce combined pressure control and flow control as represented by the pressure versus flow curves such as shown in FIG. 3. Thus, initially the valve 105*a* will cause the system to function in a velocity control mode, that is, the flow is constant up to the predetermined setting of the valve 105*a***, as established by the spring. As the pressure increases, the valve will open thereafter causing the system to function in a pressure control mode.

Figure 4:
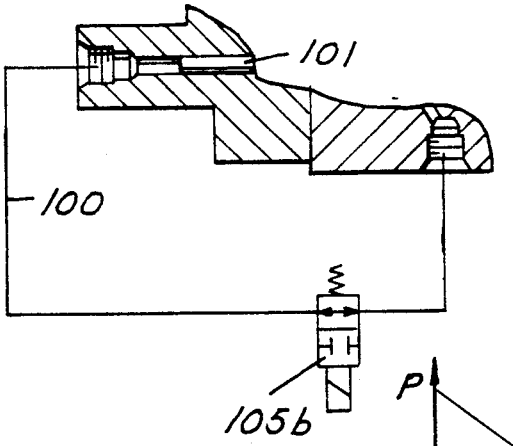
FIG. 4 is a schematic of another form of a system.
Figure 5:
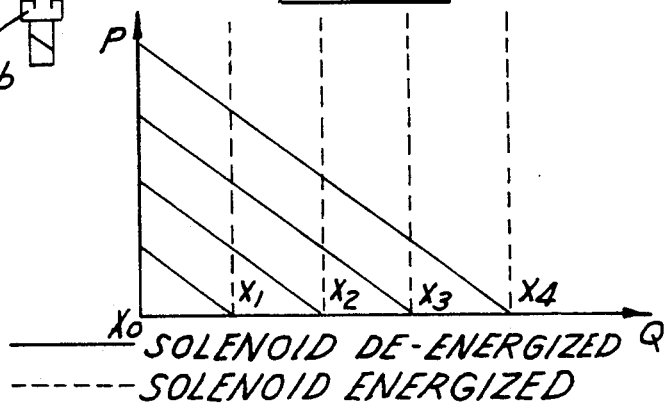
FIG. 5 is a curve of pressure versus flow for the system of FIG. 4.

The valve 105 may also be a solenoid operated on-off valve **105*b* as shown in FIG. 4 producing combined pressure control and flow control as shown in the curves of pressure and flow shown in FIG. 5. Thus, when the valve 105*b* is closed, the system will function in a velocity control mode, as shown by the broken line curves, and when the valve 105*b*** is open, the system will function in a pressure control mode.

When the on-off valve **105*b* is in open position, and the spool of the valve 27 is moved by pilot pressure, for example, to the left in order to supply pressure to port A of the rotor actuator 20, outlet pressure from the valve acts through line 100 to apply a pressure to the force rod 101 at the opposite end of the meter-in valve 27 opposing the force tending to open the spool. The system in this mode thus functions in a manner similar to that of the aforementioned U.S. Pat. No. 4,407,122 to provide smooth starting and stopping and accurate control of the movement of the actuator. When the valve 105*b*** is closed, the system functions in a flow or velocity control mode.

It can thus be seen that there has been provided a hydraulic system which can be operated selectively in a flow or velocity control mode or a pressure control mode; which can be readily applicable to a hydraulic system having velocity control; which in one form modulates force applied to the meter-in valve means opposing pilot pressure to the meter-in valve means; and which in another form can cause the hydraulic system to function either in a flow or velocity control mode or a pressure control mode.

I claim:

1. A hydraulic control system comprising a hydraulic actuator having opposed openings adapted to alternately function as inlets and outlets for moving an element of the actuator in opposite direction, a pump for supplying fluid to said actuator, a directional valve comprising pilot operated meter-in valve means to which the fluid from the pump is supplied, a pair of lines extending from said meter-in valve means to said respective openings of said actuator, a pilot operated meter-out valve means separate from and operable independently of said meter-in valve means associated with each opening of the actuator for controlling the flow out of said actuator, means for sensing outlet pressure in one of said lines to the actuator when the meter-in valve means is operated and providing a force proportional to outlet pressure on said meter-in valve means opposing the force of pilot pressure tending to actuate the meter-in valve means, said means for sensing the outlet pressure and providing a force proportional to the outlet pressure comprising a force rod having one end associated with said meter-in valve means, said force rod having the other end associated with outlet pressure, a pressure feedback line extending from the other end of said force rod and one of said first lines from the meter-in valve means to one of the openings of the actuator, and control valve means in said feedback line for selectively controlling the pressure in said feedback line, said control valve means being selected from a group consisting of:

(a) an on-off valve such that when the valve is in an open position the system functions in a pressure control mode and pilot pressure is applied to said meter-in valve means outlet pressure in the feedback line applies pressure to the force rod opposing the force tending to open the meter-in valve means to provide smooth starting and stopping and accurate control of the actuator and such that when the on-off valve is closed, the system functions in a velocity control mode;

(b) a modulating valve comprising an internally vented relief valve providing combined pressure control and flow control wherein initially the valve causes the system to function in a velocity control mode wherein the system flow is constant up to the predetermined setting of the valve and when the system pressure exceeds a predetermined setting, the valve will open and the system functions in said pressure control mode.

2. The hydraulic control system set forth in claim 1 wherein said meter-in valve means, force rod and pilot operated meter-out means are in a single body and said second line and control valve are external to said body.

3. The hydraulic control system set forth in claim 1 wherein said meter-in valve means, force rod and pilot operated meter-out means are in a single body and said second line and control valve is internal to said single body.

* * * * *